United States Patent [19]

Wing

[11] 4,095,778

[45] Jun. 20, 1978

[54] COMBINATION WORK TABLE AND VISE

[76] Inventor: Harold R. Wing, 1185 E. 225 North, Springville, Utah 84663

[21] Appl. No.: 818,178

[22] Filed: Jul. 22, 1977

[51] Int. Cl.[2] ..... B25B 1/02

[52] U.S. Cl. ..... 269/71; 269/139

[58] Field of Search ..... 269/71, 139, 84, 244

[56] References Cited

U.S. PATENT DOCUMENTS

| | | | |
|---|---|---|---|
| 1,603,307 | 10/1926 | Anderson | 269/71 |
| 2,846,761 | 8/1958 | Evans | 269/84 |
| 3,841,619 | 10/1974 | Hickman | 269/244 |

*Primary Examiner*—Robert C. Watson

*Attorney, Agent, or Firm*—H. Ross Workman; J. Winslow Young

[57] ABSTRACT

A combination work table and vise. The work table is vertically adjustable and has a tiltable work platform which is tiltable about a longitudinal axis so as to provide a sloped working surface. The tiltable work platform also reduces the dimensions of the work table for transportation and storage. The work platform includes at least two leaves, at least one of which can be moved laterally relative to the other to provide a vise action between the leaves. Lateral leaf movement is accomplished by means of a hand crank and screw combination. The hand crank is rotatably mounted to a first leaf while the screw is threadedly engaged in a swivel block mounted to a second leaf. Rotation of the hand crank moves at least one leaf relative to the other and thereby accommodates clamping a workpiece between the two leaves in an action similar to the jaws of a vise. The swivel accommodates asymetrical, lateral movement of the second leaf thereby accommodating clamping of a nonsymetrical object between the two leaves. The hand crank may also be interconnected to a second swivel to provide both leaves with asymetrical lateral movement.

5 Claims, 4 Drawing Figures

COMBINATION WORK TABLE AND VISE

BACKGROUND

1. Field of the Invention

The present invention relates to foldable work tables and, more particularly, to a tiltable, foldable work table and vise combination.

2. The Prior Art

Work tables and/or work benches are used for various purposes in the construction trades, by homeowners, hobbyists, and the like. These work tables are generally fabricated from available materials to suit the individual requirements of the user. As such, they are generally rigid, permanent fixtures which are movable only with difficulty and do not lend themselves to being readiy stored. Accordingly, when not in use, the conventional work table occupies a significant portion of the usuable space in a shop or the like. Additionally, since the conventional work table is rigid and, therefore, not foldable, it is transportable only with difficulty and usually requires more than one person for the purpose of handling.

Furthermore, the top or working surface of the work table is usually rigidly fixed as a horizontal surface to the legs and/or support structure. As such, the horizontal work surface does not lend itself to providing a sloped work surface where a sloped work surface would prove advantageous to the user. In addition, the horizontal work surface has fixed dimensions and does not lend itself readily to the incorporation of an additional leaf or leaves for the purpose of expanding the area of the work surface.

Conventional work tables also require the inclusion of separate vise or clamp arrangement when it is desired to secure a workpiece to the work table. The vise is a separate tool and thereby interferes with the overall surface of the work table.

In view of the foregoing, it would be an advancement in the art to provide a work table which is foldable, tiltable, expandable, and vertically adjustable. An even still further advancement in the art would be to provide a work table wherein the working surface is comprised of at least two leaves, at least one of which is laterally movable relative to the other. Lateral leaf movement would accommodate clamping a workpiece between the leaves and, therefore, to the work table. An even still further advancement in the art would be to provide a work table wherein at least one leaf can be moved asymetrically to accommodate clamping an irregular-shaped object to the work table. Such an invention is disclosed herein.

BRIEF SUMMARY AND OBJECTS OF THE INVENTION

The present invention relates to an improved work table which is foldable and vertically adjustable and readily accommodates an extra leaf to increase the area of the work platform. The work platform is also tiltable about a longitudinal axis so as to provide an appropriately sloped working surface. The work platform is formed by at least one leaf which is laterally movable relative to another leaf. A crank/screw combination is provided to accommodate lateral leaf movement. A swivel serves as the interconnection between the screw and one leaf so as to accommodate asymetrical lateral movement of the leaf for clamping an asymetrical object between the two leaves.

It is, therefore, a primary object of this invention to provide improvements in work tables.

Another object of this invention is to provide a foldable work table.

Another object of this invention is to provide a work table wherein the work platform is tiltable about a longitudinal axis.

Another object of this invention is to provide a work table with an expandable work platform having more than one leaf wherein at least one leaf is movable relative to another to accommodate receipt of an object between the leaves.

Another object of this invention is to provide a work platform which provides a vise-like action between two leaves.

These and other objects and features of the present invention will become more fully apparent from the following description and appended claims taken in conjunction with the accompanying drawing.

DETAILED DESCRIPTION OF THE PREFERRED EMBODIMENTS

Figure 1:
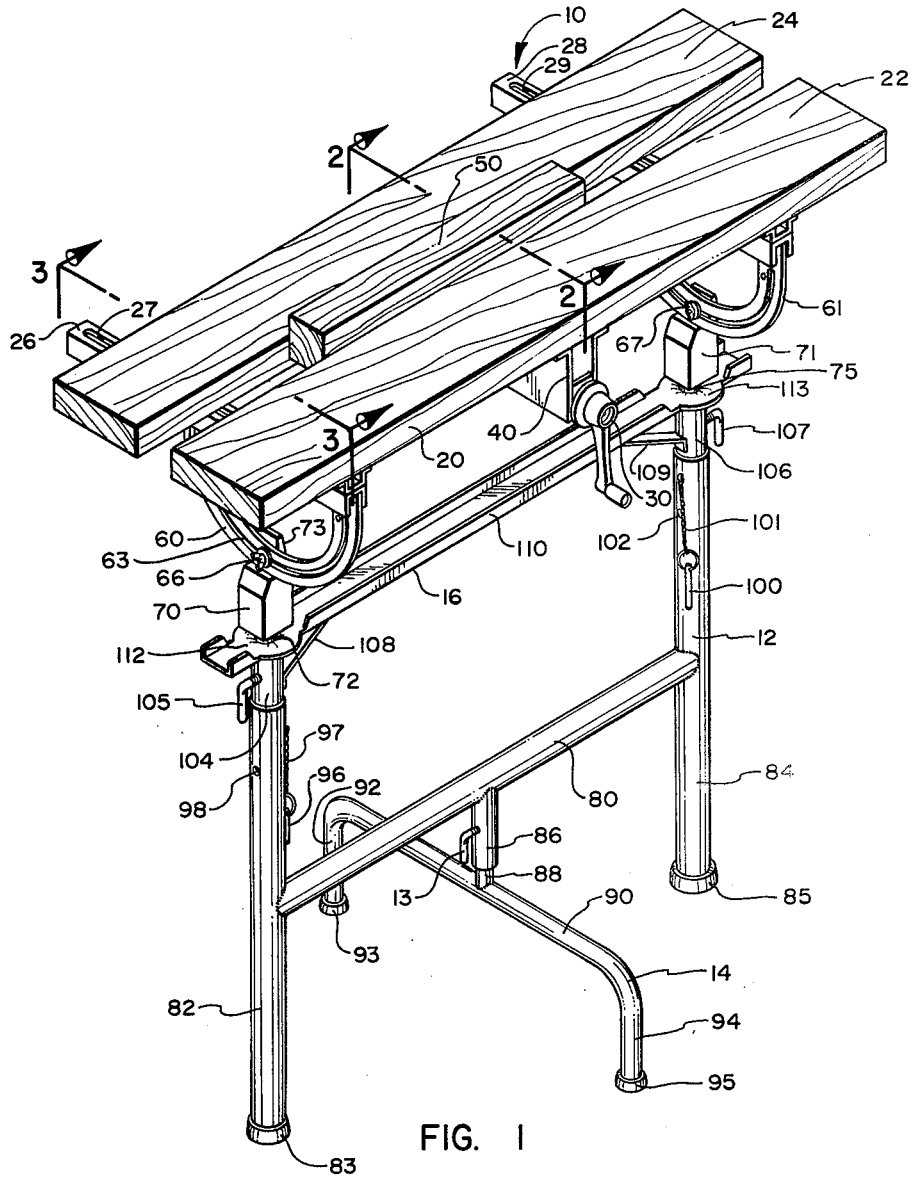
FIG. 1 is a perspective view of one preferred embodiment of the work table of this invention shown in the environment of a workpiece.

The invention is best understood by reference to the drawing wherein like parts are designated with like numerals throughout.

Referring now to the drawing, the work table of this invention is shown generally at 10 and includes a base 12, a support stand 14, a trestle 16, and a work platform 20.

Base 12 is configurated in the form of the letter H having vertical legs 82 and84 securely welded to each end of a horizontal cross piece 80. Each of vertical legs 82 and 84 are configurated as hollow tubular members so as to telescopically receive, at the upper ends thereof, vertical columns 104 and 106, respectively, of scaffold 16 as will be set forth more fully hereinafter. Vertical legs 82 and 84 terminate at the lower end in feet 83 and 85, respectively. Feet 83 and 85 are fabricated as rubber caps or the like to reduce the likelihood of slippage, surface marring, etc.

Support stand 14 is configurated with a rigid cross member 90 and downwardly depending legs 92 and 94 at each end. The lower ends of legs 92 and 94 terminate in feet 93 and 95, respectively, which are, preferably, also fabricated as caps of non-skid rubber or the like. Support stand 14 provides vertical support to base 12 by being rotated transverse to the plane of base 12 and raised or lowered relative thereto until feet 93 and 95 suitably rest on a surface. Support stand 14 is rotatably and extensibly coupled to cross piece 80 by means of a shaft 88 which is telescopically received in a hollow sleeve 86 depending downwardly from cross piece 80. A set screw 13 securely interlocks shaft 88 and sleeve 86 to thereby provide a rigid interconnection between the support stand 14 and base 12. Support stand 14 may be folded coplanar with base 12 to reduce the overall profile of work table 10 for ease of moving and storage.

The structure of base 12, including vertical legs 82 and 84 and cross piece 80, support stand 14, including cross member 90 and legs 92 and 94, is fabricated from hollow, tubular material so as to be sufficiently light weight while providing the necessary structural strength to base 12 and support stand 14.

Trestle 16 is configurated, generally, as an inverted U and includes downwardly depending hollow columns 104 and 106 rigidly interconnected by cross arm 110. Additional rigidity to the interconnection between cross arm 110 and the respective columns 104 and 105 is provided by angle braces 108 and 109, respectively. Columns 104 and 106 are each configurated as hollow columns with an open upper end to thereby telescopically receive downwardly depending posts 72 and 75, respectively, of work platform 20. Set screws 105 and 107 serve to interlock post 72 with column 104 and post 75 with column 106, respectively.

Vertical adjustment between column 104 and vertical leg 82 is provided by a pin 96 which is adapted to be passed through aperture 98 in leg 82 and one of a plurality of corresponding apertures (not shown) in alignment in column 104. A chain 97 serves as a tether for pin 96 to preclude loss of the same. A similar pin 100 is connected by chain 101 to leg 84. Insertion of pin 100 through aperture 102 correspondingly interlocks the vertical relationship between column 106 and vertical leg 104.

The configuration of base 12, support stand 14 and trestle 16 is such that the combination of these elements serves as a basal framework for platform 20 and can also function as the basic structural component for a work horse, scaffold, or the like. This is particularly advantageous since work platform 20 of this invention is easily removable from the same. Accordingly, the upper edge of cross arm 110 is configurated as an open channel to receive a dimensionally corresponding piece of wood or the like (not shown). Additionally, the junctions between columns 104 and 105 with cross arm 110 are configurated as stages 112 and 113, respectively, and include extensions on each end to support additional elements (not shown). Clearly, various configurations could be advantageously included in the structure of trestle 16 for improved versatility of the basic support structure. However, the present invention relates to the novel features of work platform 20.

Work platform 20 is fabricated from a supporting framework including support channels 26 and 28, semicircular brackets 60 and 61, and support blocks 70 and 71, all of which provide structural support for leaves 22 and 24. Support blocks 70 and 71 are mounted on the upper ends of posts 72 and 75, respectively, and serve as anchoring means for semicircular brackets 60 and 61, respectively. For example, block 70 includes an upright flange 73 and a bolt and wing nut combination 66 which cooperates through a semicircular slot 63 in semicircular bracket 60. Semicircular slot 63 is formed between semicircular members 62 and 64 (FIG. 3) of semicircular bracket 60.

Additional support between flange 73 and semicircular bracket 60 is provided by pins 68 and 69 (FIG. 3) which are dimensionally configurated to be received in semicircular slot 63. Corresponding features are found with respect to bolt 67, semiicircular bracket 61, and block 71 (FIGS. 1 and 4) at the other end of work platform 20. In this manner, work table 20 may be selectively rotated about a longitudinal axis with sufficient stability being provided by the interlocking features of support blocks 70 and 71 with semicircular brackets, 60 and 61, respectively.

Figure 3:
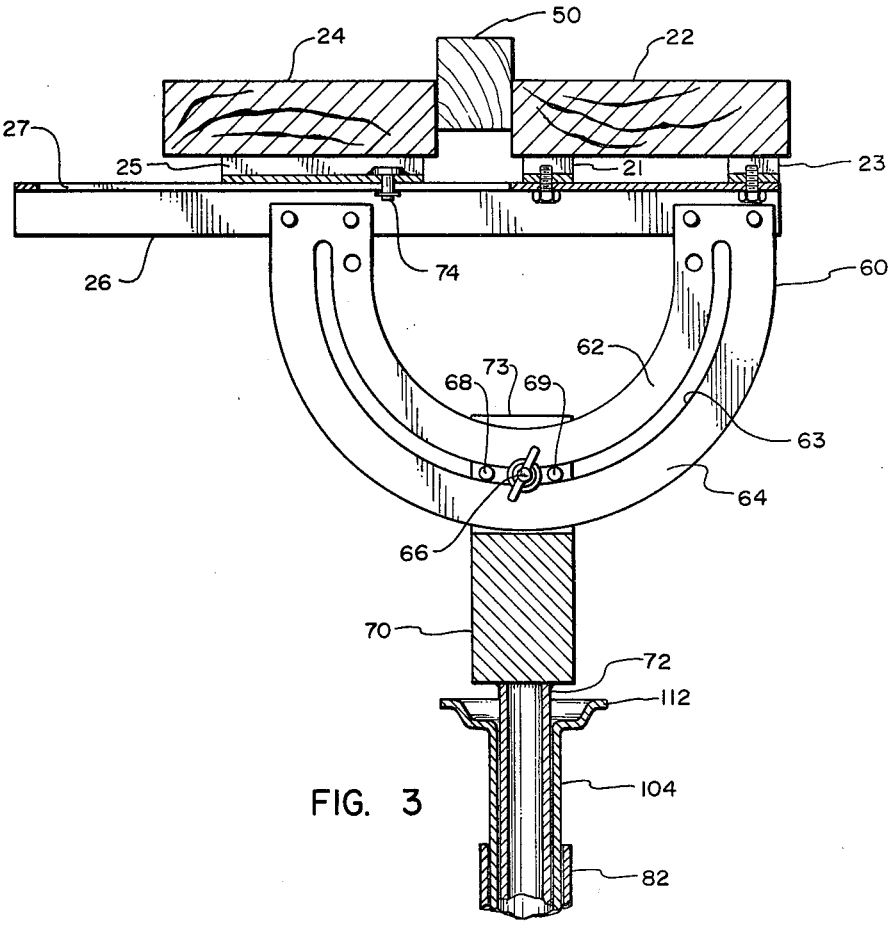
FIG. 3 is a partial cross section taken along lines 3 — 3 of FIG. 1.

Each of semicircular brackets 60 and 61 are secured at their upper ends in channel supports 26 and 28, respectively. Channel supports 26 and 28 serve as supports for leaf 22 which is bolted thereto, for example, as shown at flanges 21 and 23 (FIG. 3). Leaf 24 is configurated to be laterally movable with respect to leaf 22. Securement of leaf 24 to channel support 26 is attained by a single pin 74 in flange 25 (FIG. 3) cooperating as a guide pin in a longitudinal guide slot 27 in channel support 26. Similar interconnect features (not shown) are found at the other end of leaf 24 relative to a guide slot 29 in channel support 28. Guide slots 27 and 29 are essentially parallel and thereby serve as spaced guide tracks for movement of leaf 24. A sufficiently loose tolerance is provided between guide pin 74 and the internal dimensions of guide slot 27 so as to accommodate a limited degree of asymetrical movement of leaf 24 relative to leaf 22.

A downwardly depending boss or swivel block 42 is pivotally interconnected at a central location to leaf 24 by means of a downwardly depending capstan 44 cooperating in a plate 48 affixed to swivel block 42. Capstan 44 is securely welded to a base plate 46 which, in turn, is securely mounted to the bottom of movable leaf 24. In this manner, a single point, pivotal interconnection between swivel block 42 and leaf 24 is provided and accommodates the foregoing asymetrical movement of leaf 24 relative to leaf 22.

Figure 2:
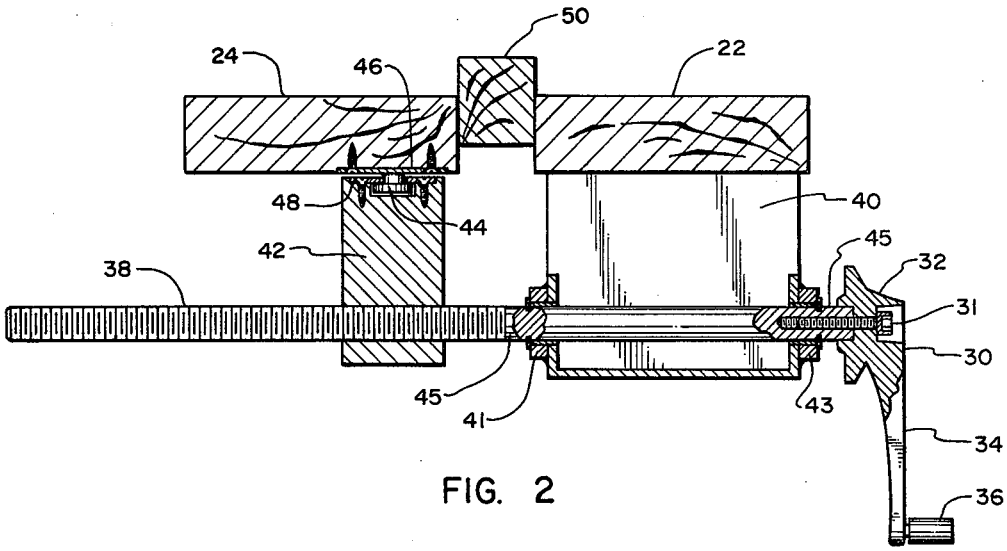
FIG. 2 is a partial cross section taken along lines 2 — 2 of FIG. 1.

Movement of leaf 24 relative to leaf 22 is accomplished by means of a screw 38 cooperating in the correspondingly threaded swivel block 42 (FIG. 2). Screw 38 is mounted on the end of a shaft 45. Shaft 45 passes through journal bearings 41 and 43 at each end of a bracket 40. Journal bearings 41 and 43 serve as thrust bearings for movement of swivel block 42 upon rotation of shaft 45 and, correspondingly, screw 38.

Crank 30 is used to rotate shaft 45 and includes a hub 32, an extension 34 and a handle 36. Securement of crank 30 to at the end of shaft 45 is accomplished by a spline interconnection between shaft 45 and hub 32 with a bolt 31 providing additional securement.

If desired, bracket 40 may be pivotally mounted to leaf 22 and guide slots 27 and 29 extended under leaf 22 to accommodate a single guide pin at each end of leaf 22 similar to guide pin 74 (FIG. 3). This latter configuration would allow leaf 22 to also be moved sayme asymetrically within the limits provided by the tolerance limitations of guide slots 27 and 29.

The versatility of the work table 10 of this invention can be more readily appreciated when one considers its portability, stability, and adjustability, particularly with respect to the various features provided by work platform 20. For example, work table 10 may be readily configurated in a storage/transportation configuration by, selectively, loosening each of bolts 66 and 67 and rotating work platform 20 about a longitudinal axis to thereby bring the surface of work platform 20 nearly parallel with base 12 and trestle 16. Additionally, support stand 14 can be pivoted until coplanar with base 12. Work table 10 is then in an essentially flat configuration for ease of handling, transportation, and storage.

Work table 10 also readily accommodates being adapted for use as a work bench, vise, etc. For example, support stand 14 provides the necessary vertical support to base 12. The appropriate vertical adjustment of trestle 16 is attained by raising columns 104 and 106 relative to vertical legs 82 and 84, respectively. Pins 96 and 100 are inserted into the respective apertures 98 and 102, respectively, to interlock the respective column of trestle 16 and leg of base 12. Vertical adjustment of work platform 20 relative to trestle 16 is attained by suitably interlocking posts 72 and 75 to columns 104 and 106, respectively, with set screws 105 and 107.

Figure 4:
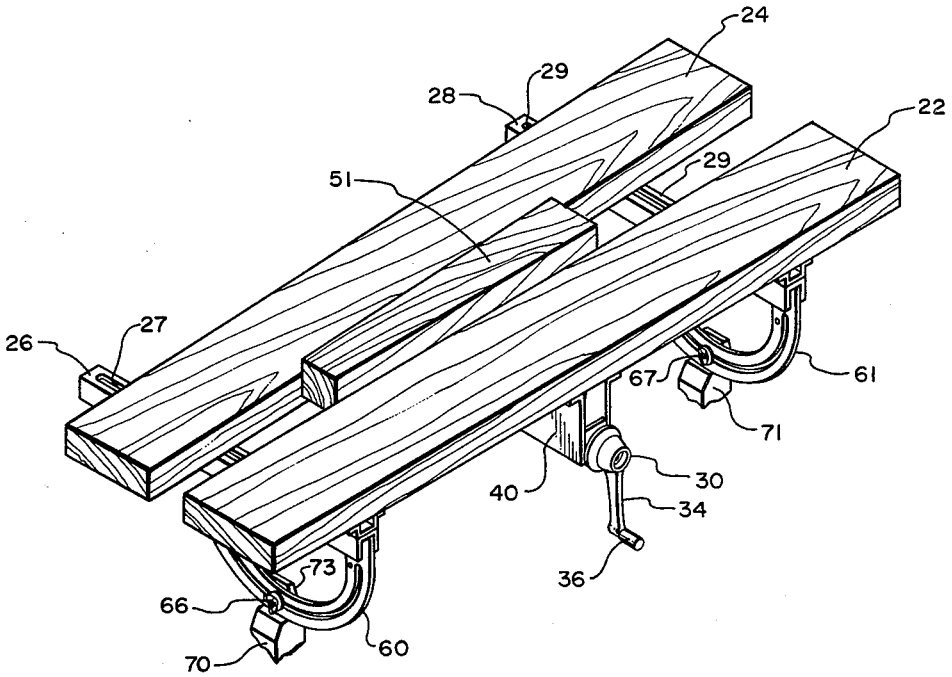
FIG. 4 is a partial perspective view of the work table of this invention shown in the environment of a second workpiece.

The angular orientation of work platform 20 is attained by selectively moving semicircular brackets 60 and 61 relative to support blocks 70 and 71, respectively, and tightening the ing nuts of bolts 66 and 67 to secure the angular orientation of work platform 20 relative to the remaining support structure of work table 10. With the angular orientation of work platform 20 selectively achieved, the operator (not shown) is able to use work platform 20 for a variety of purposes including, for example, a work surface, a vise for uniform objects such as workpiece 50 (FIG. 1) or non-uniform objects such as work piece 51 (FIG. 4). To accommodate these latter features, the operator (not shown) rotates crank 30 the appropriate direction to laterally adjust leaf 24 relative to leaf 22. The preselected workpiece (workpiece 50, FIG. 1, or workpiece 51, FIG. 4) is then inserted therebetween. Thereafter, reverse rotation of crank 30 provides the appropriate movement of leaf 24 and leaf 22 thereby clamping the workpiece therebetween. Accordingly, the work platform 20 of this invention serves not only as an improved work surface but also readily provides a vise-like action for the secure engagement of a preselected workpiece to work table 10.

If desired, an additional leaf (not shown) may be substituted for a workpiece such as workpiece 50 (FIGS. 1 - 3) to expand the surface area of work platform 20. In this event, the additional leaf (not shown) would be placed into a coplanar relationship between leaf 22 and leaf 24 so as to provide continuity of the work surface. For example, if one were to consider workpiece 50 as the additional leaf, one would selectively choose workpiece 50 to have a length which generally corresponds to leaves 22 and 24 and a thickness which would accommodate providing an essentially coextensive, coplaner upper surface with leaves 22 and 24.

The invention may be embodied in other specific forms without departing from its spirit or essential characteristics. The described embodiments are to be considered in all respects as illustrative and not restrictive and the scope of the invention is, therefore, indicated by the appended claims rather than by the foregoing description. All changes which come within the meaning and equivalency of the claims are to embraced within their scope.

What is claimed and desired to be secured by a U.S. Letters Patent is:

1. A work table comprising:

a basal framework; and a tiltable work platform mounted on the basal framework, means for tilting the work platform relative to the basal framework the tiltable work platform comprising a framework and a working surface secured to the framework, the working surface comprising at least two leaves comprising a first and a second leaf with at least the first leaf laterally displaceable with respect to the second leaf, the framework comprising two parallel, spaced tracks upon which at least the first leaf is slideably engaged, a single centrally disposed screw, a crank for turning the screw, a journal bearing through which the screw passes and which serves as a thrust bearing for the screw, and a boss secured to the first leaf and threadedly engaged to the screw, rotation of the screw moving the boss and the first leaf laterally relative to the second leaf, the boss configurated as a swivel, the swivel accommodating unequal lateral movement of the first leaf relative to the second leaf to thereby accommodate clamping an asymetrical object between the two leaves upon rotation of the screw.

2. The work table defined in claim 1 wherein the work platform further comprises a workpiece with the first leaf being laterally displaceable to accommodate receipt of the workpiece as a third leaf between the first leaf and the second leaf.

3. The work table defined in claim 1 wherein the tiltable work platform includes two arcuate brackets whereby the work platform is mounted to the basal framework, the arcuate brackets each secured to and extending downwardly from a spaced track and accommodating pivotal adjustment of the tiltable work platform about a longitudinal axis.

4. The work table defined in claim 1 wherein the tiltable work platform and the basal framework includes means for selectively altering the vertical adjustment of the tiltable work platform relative to the basal framework.

5. A work table comprising:

a base, the base having a collapsible support stand pivotally connected to the base, the support stand providing a degree of vertical support to the base;

a trestle vertically adjustable relative to the base;

a work platform comprising:

a framework mounted to the trestle in a vertically adjustable relationship;

the work platform havng a longitudinal axis and means for tilting the work platform about the longitudinal axis;

the work platform also comprising a plurality of leaves with at least a first leaf laterally adjustable relative to a second leaf thereby accommodating relative lateral movement between the first leaf and the second leaf and accommodating clamping an object between the first leaf and the second leaf;

a single, centrally located screw secured by a journal bearing to the work platform; and a swivel rotatably mounted to the first leaf to accommodate asymetrical lateral movement of the first leaf relative to the second leaf upon rotation of the screw.

* * * * *